US010838331B1

(12) United States Patent
Ishii

(10) Patent No.: US 10,838,331 B1
(45) Date of Patent: Nov. 17, 2020

(54) FIXING DEVICE AND IMAGE FORMING APPARATUS

(71) Applicant: TOSHIBA TEC KABUSHIKI KAISHA, Tokyo (JP)

(72) Inventor: Hiroshi Ishii, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/570,765

(22) Filed: Sep. 13, 2019

(51) Int. Cl.
*G03G 15/20* (2006.01)

(52) U.S. Cl.
CPC ..... *G03G 15/205* (2013.01); *G03G 15/206* (2013.01); *G03G 15/2053* (2013.01); *G03G 15/2064* (2013.01)

(58) Field of Classification Search
CPC ..... G03G 15/205; G03G 15/2053; G03G 15/206; G03G 15/2064
See application file for complete search history.

(56) References Cited

U.S. PATENT DOCUMENTS

2010/0021195 A1* 1/2010 Yura ..... G03G 15/2064 399/70
2016/0154352 A1* 6/2016 Yokoyama ..... G03G 15/2039 399/69
2018/0329342 A1* 11/2018 Seshita ..... G03G 15/205

FOREIGN PATENT DOCUMENTS

JP 2010-231099 A 10/2010

* cited by examiner

*Primary Examiner* — Sandra Brase
(74) *Attorney, Agent, or Firm* — Foley & Lardner LLP

(57) ABSTRACT

A fixing device for fixing a toner image formed on an image receiving medium to the image receiving medium includes a heating rotation member, a heating element that heats the heating rotation member, a pressure rotation member pressed to the heating rotation member and forming a nip therebetween through which the image receiving medium passes, a pressure control device that controls a pressure at which the pressure rotation member abuts against the heating rotation member. A control device controls the heating element and the pressure control device to alternately perform a process for heating the heating rotation member while the pressure rotation member abuts against the heating rotation member and a process for heating the heating rotation member while the pressure rotation member is separated from the heating rotation member.

20 Claims, 8 Drawing Sheets

FIXING DEVICE AND IMAGE FORMING APPARATUS

FIELD

Embodiments described herein relate generally to a fixing device and an image forming apparatus.

BACKGROUND

In an image forming apparatus such as a multi-function peripheral or a printer, if a temperature of a fixing belt at the start of printing is lower than an appropriate temperature, a toner is not sufficiently fixed to an image receiving medium, and thus printing failure occurs. Therefore, in order to prevent the printing failure, a warming-up processing is performed to warm the fixing device before the start of the printing.

An energy-saving medium-speed or high-speed image forming apparatus uses a fixing device of an induction heating system having a small heat capacity. In such a type of image forming apparatus, in order to shorten a time required for the warming-up processing, a fixing belt is heated first in a state in which a pressure roller is separated from the fixing belt, and then the fixing belt is heated in a state in which the pressure roller abuts against the fixing roller during the warming-up processing to perform control to store heat in a heating roller. After the pressure roller abuts against the fixing belt, if the temperature of the fixing belt reaches a predetermined temperature, or if (a) the temperature of the fixing belt reaches the predetermined temperature and (b) the fixing belt is heated for a predetermined time while the pressure roller abuts against the fixing belt, the image forming apparatus terminates the warming-up processing and shifts to a standby state.

However, if only the temperature of the fixing belt or a heating time of the fixing belt in the state in which the pressure roller abuts against the fixing belt is set as a condition for terminating the warming-up processing, the temperature of the fixing belt may be beyond a range of the appropriate temperature depending on a type of a print medium or a heat storage state of the pressure roller in some cases. If the printing is performed in a state in which the temperature of the fixing belt is beyond the range of the appropriate temperature, an image defect occurs. Since the image forming apparatus starts the printing after the temperature of the fixing belt falls within the range of the appropriate temperature, there is a problem that a waiting time from reception of a print command to the start of the printing becomes long.

DETAILED DESCRIPTION

Certain embodiments provide a fixing device for fixing a toner image formed on an image receiving medium to the image receiving medium including: a heating rotation member rotatably supported; a heating element configured to heat the heating rotation member; a pressure rotation member pressed to the heating rotation member and configured to form a nip therebetween through which the image receiving medium passes; and a control device configured to control the heating element and a pressure control device that controls a pressure at which the pressure rotation member abuts against the heating rotation member to alternately perform a processing for heating the heating rotation member in a state in which the pressure rotation member abuts against the heating rotation member and a processing for heating the heating rotation member in a state in which the pressure rotation member is separated from the heating rotation member during a warming-up processing for raising temperature of the heating element and the pressure rotation member to a standby temperature before fixing the toner image to the image receiving medium.

Hereinafter, an image forming apparatus according to the present embodiment is described with reference to the accompanying drawings. In the description, an XYZ coordinate system composed of X, Y and Z axes orthogonal to one another is used as appropriate.

Figure 1:
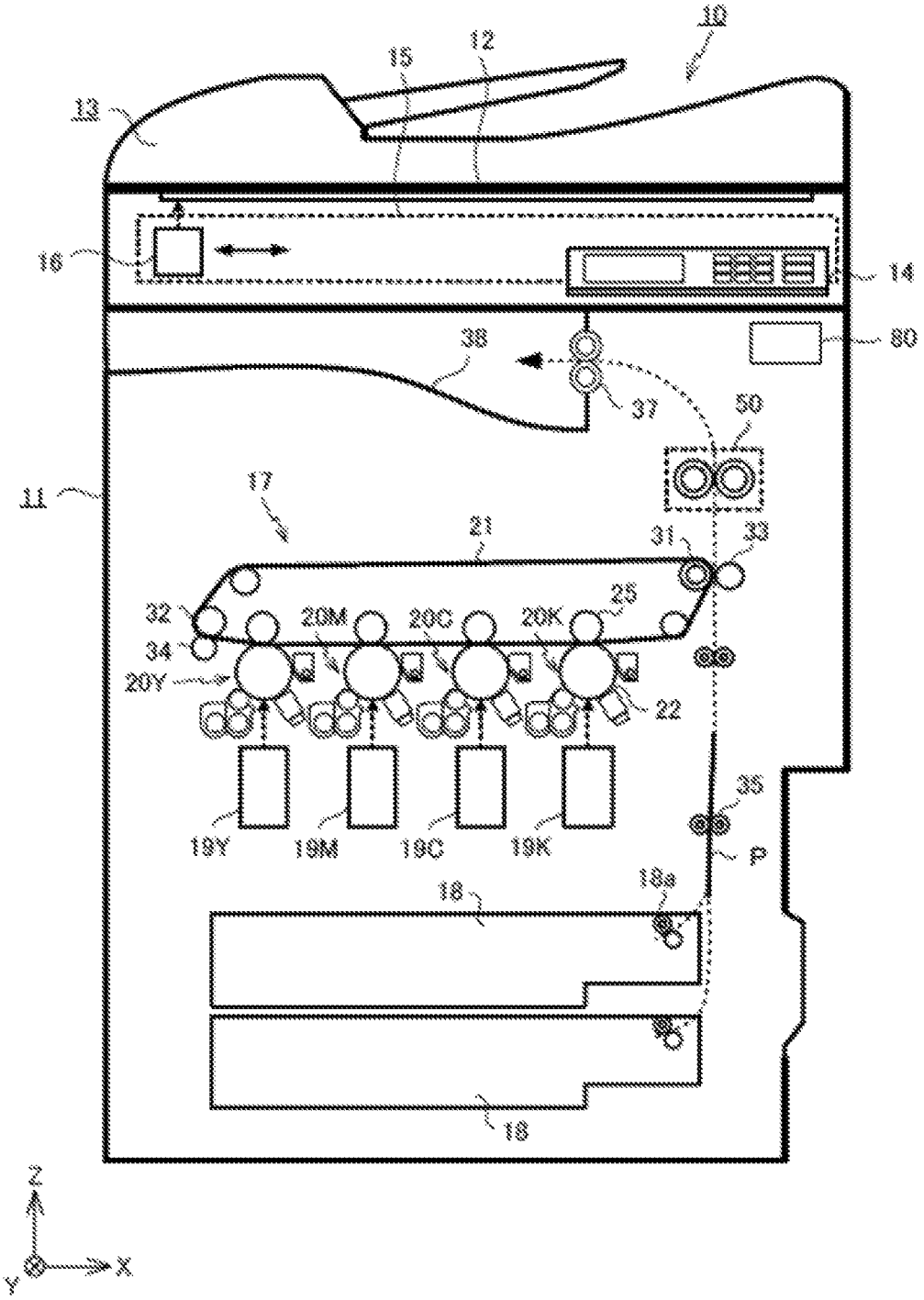
FIG. 1 is a diagram schematically illustrating a configuration of an image forming apparatus according to a first embodiment.

FIG. 1 is a diagram schematically illustrating a configuration of an image forming apparatus 10 according to the present embodiment. The image forming apparatus 10 is, for example, a Multi-Function Peripheral (MFP). The MFP 10 includes a main body 11 and an automatic document feeder (ADF) 13. A document table 12 made of transparent glass is arranged on the top of the main body 11, and the automatic document feeder 13 is provided on an upper surface side of the document table 12 in such a manner that the automatic document feeder 13 can rise, fall and pivot. An operation panel 14 is provided at an upper portion of the main body 11. The operation panel 14 includes various keys, a Graphical User Interface (GUI) and the like.

A scanner 15 for reading a document is provided below the document table 12. The scanner 15 reads a document fed by the automatic document feeder 13 or a document placed on the document table 12 to generate image data. The scanner 15 is provided with an image sensor 16.

When reading an image of a document placed on the document table 12, the image sensor 16 reads the image of the document while moving in a +X direction along the document table 12. When reading an image of a document fed to the document table 12 by the automatic document feeder 13, the image sensor 16 is fixed at a position shown in FIG. 1 and reads an image of each document among sequentially fed documents.

The main body 11 includes an image forming section 17, a fixing device 50 and a control device 80.

(Image Forming Section)

The image forming section 17 is arranged at the inside of the main body 11. The image forming section 17 forms an image on an image receiving medium such as a paper accommodated in a paper feed cassette 18 based on image data read by the scanner 15 or image data generated by a personal computer or the like.

The image forming section 17 includes image forming sections 20Y, 20M, 20C and 20K for forming latent images using toners of yellow (Y), magenta (M), cyan (C) and black (K), scanning heads 19Y, 19M, 19C and 19K provided corresponding to the image forming sections and an intermediate transfer belt 21.

The image forming sections 20Y, 20M, 20C and 20K are arranged below the intermediate transfer belt 21. In the image forming section 17, the image forming sections 20Y, 20M, 20C and 20K are arranged side by side from a −X side to a +X side. The scanning heads 19Y, 19M, 19C and 19K are arranged below the image forming sections 20Y, 20M, 20C and 20K, respectively.

Figure 2:
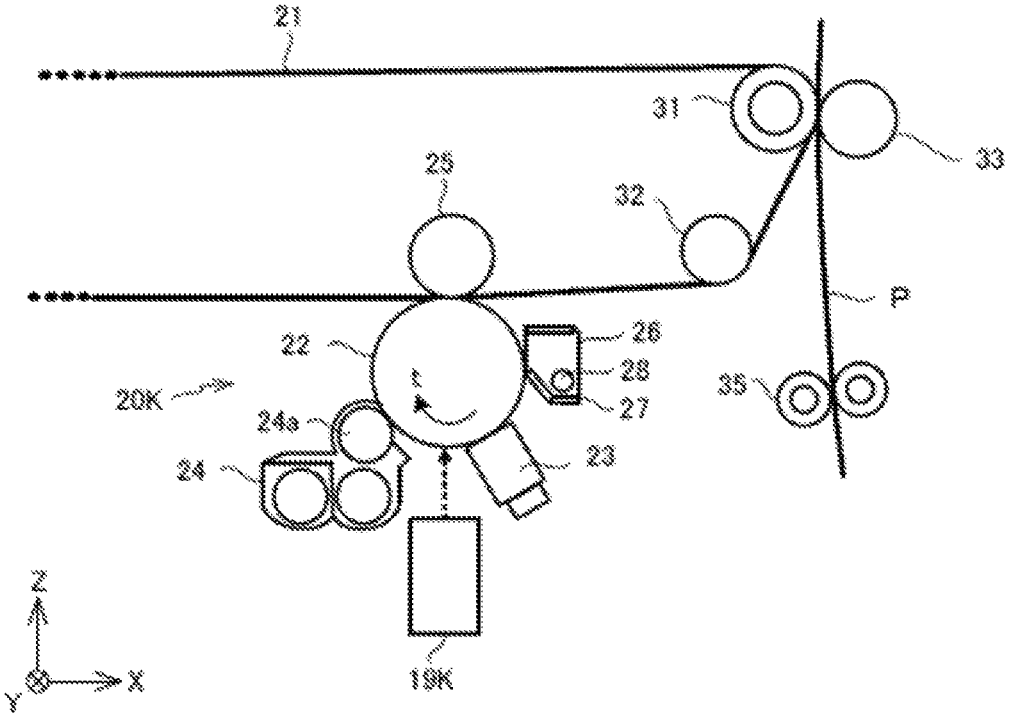
FIG. 2 is an enlarged view of an image forming section according to the first embodiment.

FIG. 2 is an enlarged view of the image forming section 20K among the image forming sections 20Y, 20M, 20C and 20K. The image forming sections 20Y, 20M, 20C and 20K have the same configuration. Therefore, the configuration of each image forming section is described using the image forming section 20K as an example.

The image forming section 20K has a photoconductive drum 22 serving as an image carrier. An electrostatic charger 23, a developing device 24, a primary transfer roller 25 and a cleaner 26 are arranged around the photoconductive drum 22 in a direction indicated by an arrow t. A laser beam is emitted from the scanning head 19K to an exposure position of the photoconductive drum 22. An electrostatic latent image is formed on a surface of the photoconductive drum 22 by irradiating the surface of the rotating photoconductive drum 22 with the laser beam.

The electrostatic charger 23 of the image forming section 20K uniformly charges the surface of the photoconductive drum 22. The developing device 24 supplies a toner to the photoconductive drum 22 through a developing roller 24*a* to which a developing bias is applied to develop the electrostatic latent image. The cleaner 26 removes the toner remaining on the surface of the photoconductive drum 22 using a blade 27. The toner scraped off through a tip of the blade 27 is conveyed by an auger 28 in a longitudinal direction.

As shown in FIG. 1, the intermediate transfer belt 21 is stretched around a drive roller 31 and three driven rollers 32. The intermediate transfer belt 21 rotates counterclockwise in FIG. 1 as the drive roller 31 rotates. As shown in FIG. 1, the intermediate transfer belt 21 abuts against an upper surface of each of the photoconductive drums 22 of the image forming sections 20Y, 20M, 20C and 20K. A primary transfer voltage is applied by the primary transfer roller 25 to a position of the intermediate transfer belt 21 facing the photoconductive drum 22. In this way, the toner image developed on the surface of the photoconductive drum 22 is primarily transferred onto the intermediate transfer belt 21.

A secondary transfer roller 33 is arranged to face the drive roller 31 that stretches the intermediate transfer belt 21. At the time a paper P passes between the drive roller 31 and the secondary transfer roller 33, a secondary transfer voltage is applied to the paper P by the secondary transfer roller 33. In this way, the toner image formed on the intermediate transfer belt 21 is secondarily transferred onto the paper P. In the vicinity of the driven roller 32 of the intermediate transfer belt 21, a belt cleaner 34 is provided, as shown in FIG. 1. The belt cleaner 34 removes the toner remaining on the surface of the intermediate transfer belt 21.

As shown in FIG. 1, a paper feed roller 35 is provided between the paper feed cassette 18 and the secondary transfer roller 33. The paper P taken out of the paper feed cassette 18 by a pickup roller 18*a* arranged in the vicinity of the paper feed cassette 18 is conveyed between the intermediate transfer belt 21 and the secondary transfer roller 33 by the paper feed roller 35.

The fixing device 50 is provided above the secondary transfer roller 33. A paper discharge roller 37 is provided above the fixing device 50. The paper P passing between the intermediate transfer belt 21 and the secondary transfer roller 33 is heated by the fixing device 50. In this way, the toner image is fixed to the paper P. The paper P passing through the fixing device 50 is discharged to a paper discharge section 38 by the paper discharge roller 37.

(Fixing Device)

Figure 3:
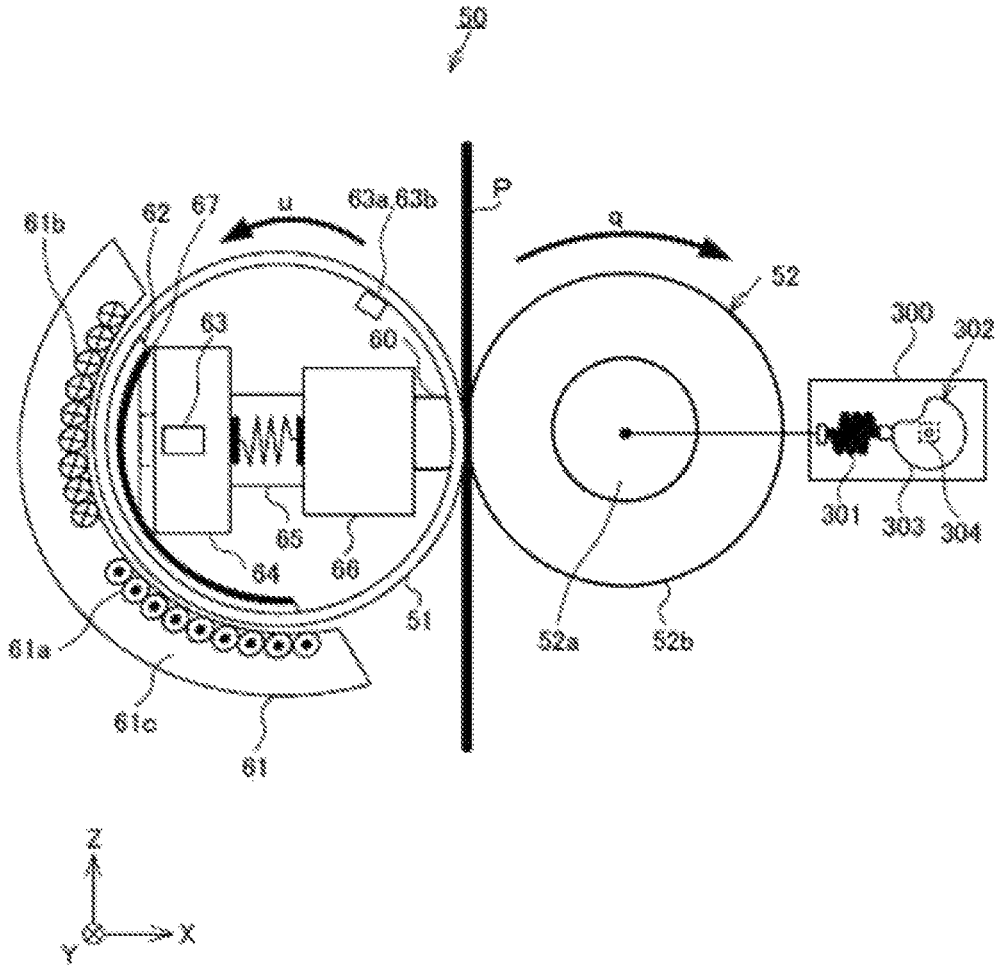
FIG. 3 is a diagram schematically illustrating a configuration of a fixing device according to the first embodiment.

Next, the fixing device 50 is described in detail. FIG. 3 is a diagram schematically illustrating a configuration of the fixing device 50. As shown in FIG. 3, the fixing device 50 includes a fixing belt 51, a pressure roller 52, a pressure control device 300 and an electromagnetic induction heating coil unit (hereinafter, abbreviated as IH coil unit) 61 serving as an induced current generating section.

The fixing belt 51 serving as a heating rotation member includes a pressure pad 60, a magnetic shunt metal 62, a holder 64, a position adjusting member 65 and an aluminum member 67 therein. At the inside of the fixing belt 51, a temperature sensor or thermostat 63, a center thermistor 63*a* and an edge thermistor 63*b* are provided. The thermostat 63 is housed in the holder 64.

The fixing belt 51 is a cylindrically shaped member extending in the Y-axis direction, and a length thereof is larger than a width of the paper P in a direction orthogonal to a conveyance direction thereof. The fixing belt 51 is driven by the pressure roller 52 to rotate or rotates independently of the pressure roller 52 around a central axis of a cylinder in a direction indicated by an arrow u while contacting with the magnetic shunt metal 62 described below. The fixing belt 51 has a multi-layer structure including a heat generation layer 51*b*.

Figure 4:
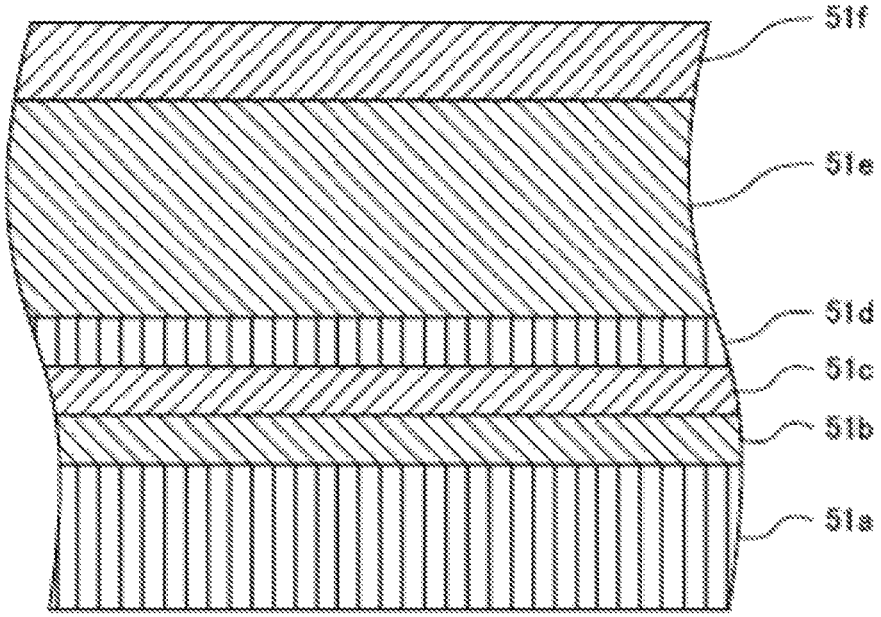
FIG. 4 is a diagram illustrating a layer constitution of a fixing belt according to the first embodiment.

FIG. 4 shows a layer structure of the fixing belt. As shown in FIG. 4, in the fixing belt 51, a base material layer 51*a*, the heat generation layer 51*b*, a conductor layer 51*c*, a Ni layer 51*d*, an elastic layer 51*e* and a release layer 51*f* are laminated in this order from an inner circumferential side towards an outer circumferential side. In the fixing belt 51, the heat generation layer 51*b* is thinly layered and a heat capacity thereof is reduced to enable the fixing belt 51 to warm up rapidly. With the fixing belt 51 of which the heat generation layer 51*b* has a small heat capacity, the time required for warming up is shortened and the energy consumption is saved.

The base material layer 51*a* of the fixing belt 51 is made of, for example, a polyimide sleeve having a thickness of 70 μm. The heat generation layer 51*b* is made of, for example, nickel having a thickness of 1 μm. The heat generation layer 51*b* generates an induced current with a magnetic flux generated in the IH coil unit 61. The heat generation layer 51*b* generates Joule heat with the induced current and a resistance value of the heat generation layer 51*b* to heat the fixing belt 51. The conductor layer 51*c* is made of, for example, copper having a thickness of 10 The Ni layer 51*d* has a thickness of, for example, 10 The elastic layer 51*e* is made of, for example, an elastic body such as silicone rubber having a thickness of 200 The release layer 51*f* is made of, for example, a PFA tube having a thickness of 30 μm.

Returning again to FIG. 3, the pressure roller 52 serving as a pressure rotation member is a cylindrical member extending in the Y-axis direction. The pressure roller 52 includes a core 52*a* made of metal such as aluminum, and a silicone rubber layer 52*b* laminated on an outer circumferential surface of the core 52*a*. The surface of the silicone rubber layer 52*b* is coated with PFA resin or the like. The pressure roller 52 has, for example, an outer diameter of about 25 mm and a length approximately equal to the length of the fixing belt 51. The pressure roller 52 rotates in a direction indicated by an arrow q. The pressure roller 52 is energized in a −X direction towards the fixing belt 51 by the pressure control device 300, and is pressed to the pressure pad 60 across the fixing belt 51. Thereby, the surface of the pressure roller 52 is in close contact with the surface of the fixing belt 51, and thus a nip through which the paper P passes from a lower side to an upper side thereof is formed.

The pressure control device 300 includes an elastic section 301 and a drive section 302. The elastic section 301 is made of an elastic body such as a spring. One end of the elastic section 301 is connected to the pressure roller 52, and the other end thereof abuts against the drive section 302. The drive section 302 includes a cam 303 and a driver or drive motor 304 that drives the cam 303. The drive motor 304 is controlled by the control device 80 to drive the cam 303 to rotate. The cam 303 is formed of a cylindrical member having a substantially circular cross section in which a concave portion is formed in a part of the outer circumference thereof. At the time the elastic section 301 abuts against a convex portion of the cam 303, the pressure roller 52 abuts against the fixing belt 51. At the time the elastic section 301 abuts against the concave portion of the cam 303, the pressure roller 52 is separated from the fixing belt 51.

The pressure pad 60 presses the inner circumferential surface of the fixing belt 51 to the pressure roller 52 side to form a nip between the fixing belt 51 and the pressure roller 52. The pressure pad 60 is made of, for example, heat-resistant Polyphenylene Sulfide Resin (PPS), Liquid Crystal Polymer (LCP), Phenol Resin (PF), or the like. A sheet having properties that facilitate sliding and good wear resistance or a release layer made of fluorocarbon resin included in the pressure pad 60 may be provided between the heat-resistant fixing belt 51 and the pressure pad 60. The sheet or the release layer reduces a frictional resistance between the fixing belt 51 and the pressure pad 60.

The IH coil unit 61 is a heating element that heats the fixing belt 51. As shown in FIG. 3, the IH coil unit 61 includes coils 61*a* and 61*b* serving as magnetic flux generating sections, and a core 61*c*. The IH coil unit 61 is provided on the outer circumference of the fixing belt 51 with the coils 61*a* and 61*b* opposite to the fixing belt 51. The core 61*c* concentrates the magnetic flux from the coils 61*a* and 61*b* in the direction of the fixing belt 51. The IH coil unit 61 generates the induced current in the heat generation layer 51*b* of the fixing belt 51 facing the IH coil unit 61 while the fixing belt 51 rotates in the direction indicated by the arrow u.

The magnetic shunt metal 62 is arranged in an arc shape along the inner circumferential surface of the fixing belt 51, and faces the IH coil unit 61 across the fixing belt 51. The magnetic shunt metal 62 is made of a magnetic shunt alloy of which a magnetic permeability changes with temperature, and the magnetic permeability decreases rapidly as a temperature thereof approaches the Curie temperature Tc thereof. The magnetic shunt metal 62 is made of, for example, an iron-nickel magnetic shunt alloy having the Curie temperature Tc of 200° C. The Curie temperature Tc is set to, for example, about 40° C. higher than the fixing temperature. If the temperature of the magnetic shunt metal 62 is lower than the Curie temperature Tc, the magnetic permeability of the magnetic shunt metal 62 is high, and thus a magnetic flux density through the fixing belt 51 is high. Therefore, a calorific value of the fixing belt 51 can be increased. The magnetic shunt metal 62 generates heat with the magnetic flux generated by the IH coil unit 61. Since the magnetic shunt metal 62 is in contact with the fixing belt 51, the magnetic shunt metal 62 functions as an auxiliary heating member of the fixing belt 51. On the other hand, the magnetic permeability of the magnetic shunt metal 62 decreases rapidly and the magnetic flux density through the fixing belt 51 is reduced as the temperature of the magnetic shunt metal 62 approaches the Curie temperature Tc. In this way, the magnetic shunt metal 62 reduces the calorific value of the fixing belt 51 to suppress a temperature rise of a non-paper passing portion of the fixing belt 51.

The aluminum member 67 is formed in an arc shape along an inner circumferential surface of the magnetic shunt metal 62. The aluminum member 67 is made of, for example, a nonmagnetic member such as aluminum (Al) or copper (Cu). The aluminum member 67 shields the magnetic flux from the IH coil unit 61 to prevent the influence of the magnetic flux on the surrounding electronic components and the like.

The center thermistor 63*a* is arranged in the vicinity of the center of the fixing belt 51 in the Y-axis direction to detect the temperature of the vicinity of the center of the fixing belt 51 in the Y-axis direction. The edge thermistor 63*b* is arranged in the vicinity of an end of the fixing belt 51 in the Y-axis direction to detect the temperature of the vicinity of the end of the fixing belt 51 in the Y-axis direction.

The thermostat 63 detects the temperature of the magnetic shunt metal 62. If the thermostat 63 detects abnormal heat generation of the magnetic shunt metal 62, the supply of electric power to the IH coil unit 61 is stopped.

The thermostat 63 is housed in the holder 64. The holder 64 abuts against the magnetic shunt metal 62 and supports the thermostat 63 at a position separated from the magnetic shunt metal 62. As shown in FIG. 3, the holder 64 is pressed against the magnetic shunt metal 62 by the position adjusting member 65. One end of the position adjusting member 65 is fixed to the holder 64, and the other end thereof is fixed to the support member 66. The support member 66 is fixed to, for example, a frame of the MFP 10 or the fixing device 50.

The position adjusting member 65 presses the holder 64 against the magnetic shunt metal 62 to prevent the holder 64 from being separated from the magnetic shunt metal 62. The position adjusting member 65 is, for example, a spring.

(Control Device)

Figure 5:
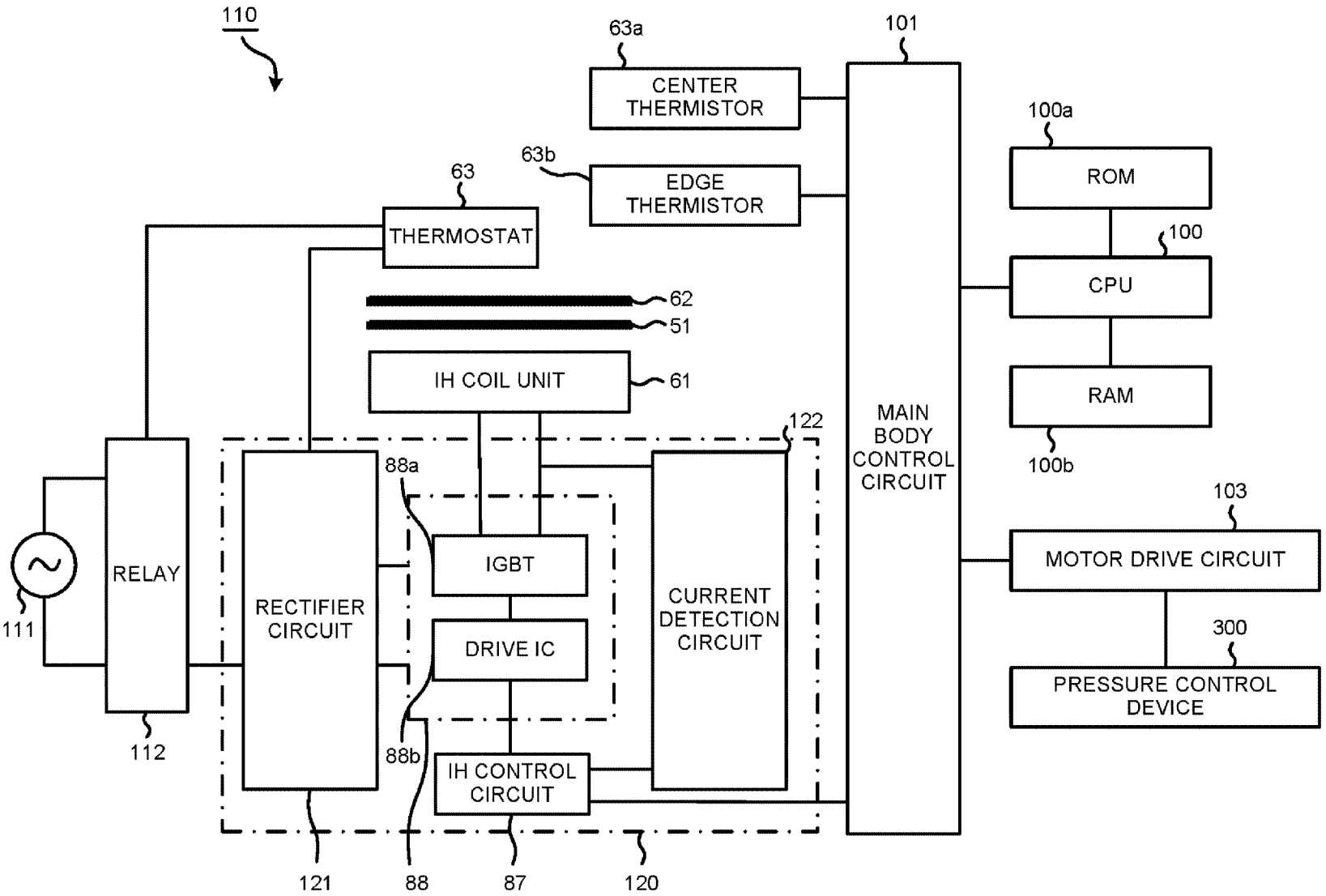
FIG. 5 is a block diagram schematically illustrating a control system of the fixing device according to the first embodiment.

Next, a control system 110 that mainly controls the IH coil unit 61 that heats the fixing belt 51 is described in detail with reference to FIG. 5. The control system 110 includes, for example, a Central Processing Unit (CPU) 100 that controls the entire MFP 10, a Read Only Memory (ROM) 100*a*, a Random Access Memory (RAM) 100*b*, a main body control circuit 101, a motor drive circuit 103 and an IH circuit 120. The control system 110 supplies electric power to the IH coil unit 61 through the IH circuit 120.

The main body control circuit 101 functions as the control device 80 that controls the motor drive circuit 103 and the IH circuit 120 based on an instruction from the CPU 100.

The motor drive circuit 103 controls various rollers and the drive motor 304 of the pressure control device 300. At the time of warming up, the motor drive circuit 103 performs control so as to enable the pressure roller 52 to abut against the fixing belt 51 or separate the pressure roller 52 from the fixing belt 51 through the pressure control device 300.

The IH circuit 120 includes a rectifier circuit 121, an IH control circuit 87, an inverter drive circuit 88 and a current detection circuit 122. The IH circuit 120 rectifies a current input from a commercial AC power supply 111 via a relay 112 in the rectification circuit 121 to supply the rectified current to the inverter drive circuit 88. The inverter drive circuit 88 includes an Insulated Gate Bipolar Transistor (IGBT) 88*a* and a drive Integrated Circuit (IC) 88*b*.

The current detection circuit 122 detects an output from the IGBT 88*a* and feeds back the detected output to the IH control circuit 87. The IH control circuit 87 performs a feedback control on the drive IC 88*b* so that the electric power supplied to the IH coil unit 61 becomes constant according to the detection result of the current detection circuit 122. The IH control circuit 87 controls the drive IC 88*b* according to the detection results of the center thermistor 63*a* and the edge thermistor 63*b* acquired via the main body control circuit 101 to control the output from the IGBT 88*a*.

The thermostat 63 maintains a connection state if a temperature of the magnetic shunt metal 62 is lower than an abnormal temperature. The relay 112 continues supplying the current from the commercial AC power supply 111 to the IH circuit 120. Therefore, the supply of the current from the IGBT 88*a* to the IH coil unit 61 is continued.

If the temperature of the magnetic shunt metal 62 reaches the abnormal temperature, a bimetal of the thermostat 63 operates. The relay 112 shuts off the supply of the current from the commercial AC power supply 111 to the IH circuit 120 when the bimetal of the thermostat 63 operates. Therefore, the supply of a high frequency current from the IGBT 88*a* to the IH coil unit 61 is stopped.

(Warming-Up Processing)

Figure 6:
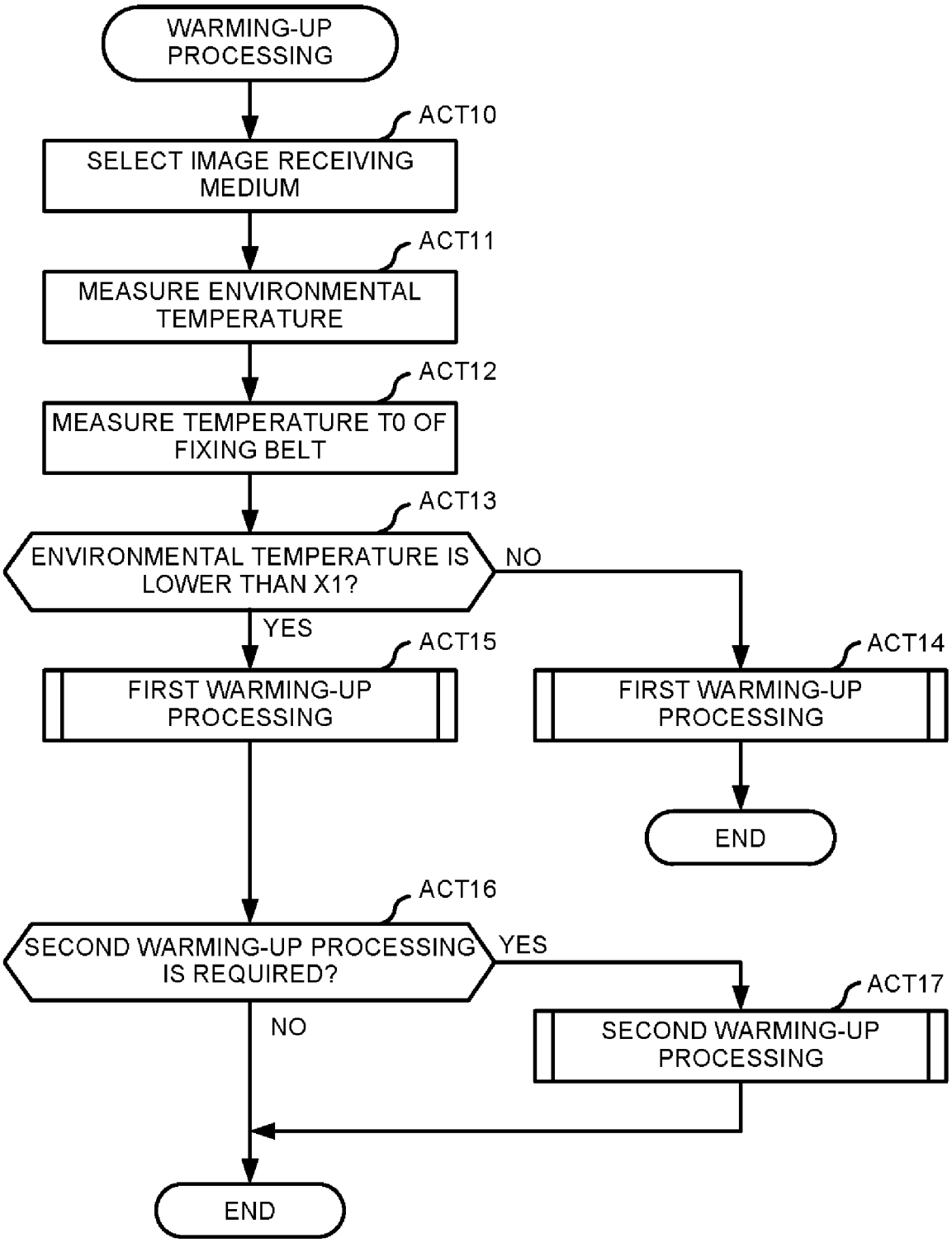
FIG. 6 is a flowchart depicting a warming-up processing performed by the image forming apparatus according to the first embodiment.

Next, operations of the fixing device 50 during the warming-up processing are described with reference to FIG. 6.

A user may designate a type of an image receiving medium to be used for printing through the operation panel 14. For example, a plain paper, a quality paper, a recycled paper, a Japanese paper, a kraft paper, etc. may be designated as the image receiving medium. If the user does not designate the image receiving medium, the MFP 10 selects the plain paper as the image receiving medium (Act 10).

The MFP 10 starts the warming-up processing when the user turns on the MFP 10. The warming-up processing is a processing of raising the temperature of the fixing belt 51 and the pressure roller 52 to the standby temperature before fixing the toner image to the image receiving medium. The standby temperature is a temperature at which the printing can be performed if a print command is received. The warming-up processing is performed, for example, when the MFP 10 is turned on or the MFP 10 in a sleep state receives the print command.

First, the control device 80 measures an environmental temperature with a temperature sensor (not shown) provided in the MFP 10 (Act 11). The environmental temperature is, for example, a temperature of a floor on which the MFP 10 is disposed.

The control device 80 measures an initial temperature T0 of the fixing belt 51 at the start of the warming-up processing (Act 12).

Next, the control device 80 determines whether or not the measured environmental temperature is lower than a predetermined temperature X1 (Act 13). The predetermined temperature X1 is, for example, 17° C. If the environmental temperature is equal to or higher than the predetermined temperature X1 (No in Act 13), the control device 80 performs a first warming-up processing (Act 14), and then terminates the warming-up processing.

Figure 7:
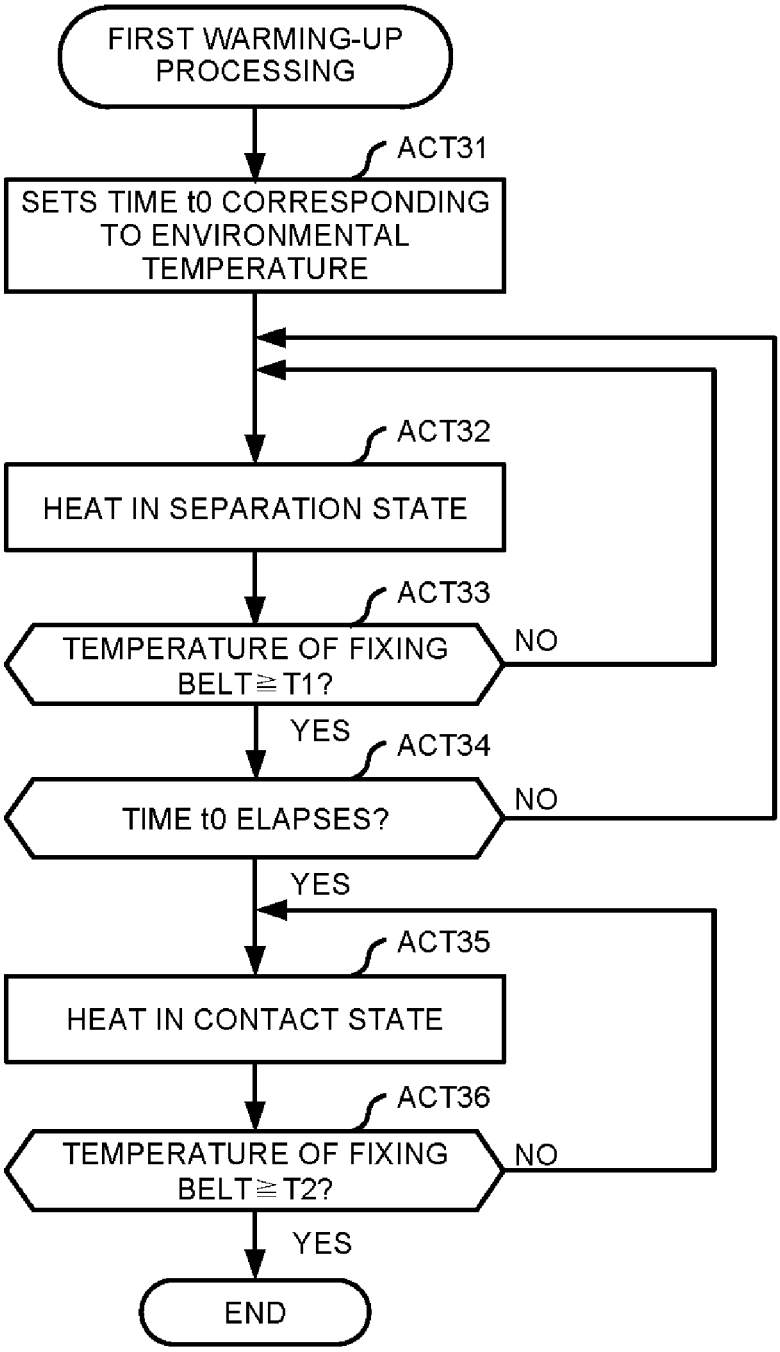
FIG. 7 is a flowchart depicting the warming-up processing performed by the image forming apparatus according to the first embodiment.

The first warming-up processing is described with reference to FIG. 7. First, the control device 80 sets a time t0 corresponding to the environmental temperature (Act 31). Specifically, the control device 80 sets the time t0 in such a manner that the lower the environmental temperature is, the larger a value of the time t0 becomes. For example, the control device 80 sets the time t0 to 10 seconds when the environmental temperature is 10° C., and sets the time t0 to 15 seconds when the environmental temperature is 0° C. A table showing a relationship between the environmental temperature and the time t0 is determined based on experimental data, and is stored in the ROM 100*a* in advance.

Next, the control device 80 controls the IH circuit 120 to supply electric power to the IH coil unit 61 to heat the fixing belt 51. At the time the warming-up processing is started, the pressure roller 52 is in a state of being separated from the fixing belt 51. Therefore, the fixing belt 51 is heated in the state of being separated from the pressure roller 52 (Act 32).

The control device 80 determines whether or not the temperature of the fixing belt 51 is equal to or higher than T1 (Act 33). The temperature T1 is, for example, 155° C. If the temperature of the fixing belt 51 is lower than T1 (No in Act 33), the control device 80 repeats the processing in Act 32 and Act 33. On the other hand, if the temperature of the fixing belt 51 is equal to or higher than T1 (Yes in Act 33), the control device 80 determines whether or not the time t0 has elapsed since the warming-up processing was started (Act 34). If the elapsed time from the start of the warming-up processing is less than t0 (No in Act 34), the control device 80 repeats the processing in Act 32 to Act 34. On the other hand, if the elapsed time from the start of the warming-up processing is equal to or larger than t0 (Yes in Act 34), the control device 80 proceeds to the processing in Act 35.

The control device 80 controls the pressure control device 300 to enable the pressure roller 52 to abut against the fixing belt 51. The fixing belt 51 is heated in a state of abutting against the pressure roller 52, and the heat of the fixing belt 51 is accumulated in the pressure roller 52 (Act 35).

The control device 80 determines whether or not the temperature of the fixing belt 51 is equal to or higher than T2 (Act 36). The temperature T2 is set, for example, to a temperature slightly higher than the standby temperature. For example, if the standby temperature is 165° C., the temperature T2 is set to 170° C. If the temperature of the fixing belt 51 is lower than T2 (No in Act 36), the control device 80 repeats the processing in Act 35 and Act 36. On the other hand, if the temperature of the fixing belt 51 is equal to or higher than T2 (Yes in Act 36), the control device 80 terminates the warming-up processing.

Returning again to FIG. 6, if the environmental temperature is lower than the predetermined temperature X1 (Yes in Act 13), the control device 80 performs the first warming-up processing (Act 15), and then proceeds to the processing in Act 16. The description of the processing in Act 15 is the same as that of the processing in Act 14.

Next, the control device 80 determines whether or not a second warming-up processing is required (Act 16). The control device 80 determines whether or not the second warming-up processing is required based on the environmental temperature measured in Act 11 and the temperature T0 of the fixing belt 51 measured in Act 12. Specifically, if the temperature T0 of the fixing belt 51 before the start of the warming-up processing is low, the control device 80 determines that the second warming-up processing is required. When the temperature T0 of the fixing belt 51 before the start of the warming-up processing is low, it can be estimated that the temperature of the pressure roller 52 is also low. This is because there is a high possibility that the temperature of the inside of the pressure roller 52 is low even if the first warming-up processing is finished when the temperature of the pressure roller 52 is low. For example, if the temperature T0 of the fixing belt 51 before the start of the warming-up processing is lower than a threshold temperature T3, the control device 80 determines that the second warming-up processing is required.

A value of the threshold temperature T3 changes depending on the heat capacity of the image receiving medium and the heat capacities of the fixing belt 51 and the pressure roller 52. The threshold temperature T3 changes with the environmental temperature. The value of the threshold temperature T3 is determined based on an experiment or the like. A table showing the value of the threshold temperature T3 set for each environmental temperature and each image receiving medium is stored in the ROM 100*a* in advance.

If it is determined that the second warming-up processing is not required (No in Act 16), the control device 80 terminates the warming-up processing.

On the other hand, if it is determined that the second warming-up processing is required (Yes in Act 16), the control device 80 performs the second warming-up processing (Act 17). The second warming-up processing is described with reference to FIG. 8.

When shifting to the second warming-up processing, the control device 80 sets the number of times the heating of the fixing belt 51 in a state in which the pressure roller 52 abuts against the fixing belt 51 and the heating of the fixing belt 51 in a state in which the pressure roller 52 is separated from the fixing belt 51 are repeated (Act 51). The purpose of repeating contact and separation is to enable the temperature of the inside of the pressure roller 52 to be close to the temperature of the surface of the pressure roller 52 while keeping the temperature of the pressure roller 52 within the range of the appropriate temperature. Specifically, the heat is accumulated up to the central portion of the pressure roller 52 to raise the temperature of the inside of the pressure roller 52 while the surface temperature of the pressure roller 52 is prevented from becoming equal to or higher than the appropriate temperature. Therefore, the number of times of repetition is set to a larger value as the temperature T0 of the fixing belt 51 before the warming-up processing becomes lower. The number of times of repetition is set to a larger value as the environmental temperature becomes lower. The number of times of repetition is set to a larger value as the heat capacity of the pressure roller 52 increases, or as a diameter of the pressure roller 52 is larger. A table showing the relationship between the temperature T0 of the fixing belt 51 before the warming-up processing and the environmental temperature and the number of times of repetition is determined based on the experimental data and stored in the ROM 100*a* in advance. The control device 80 sets the number of times of repetition with reference to the table. Here, a case in which the number of times the fixing belt 51 is heated in a state in which the pressure roller 52 abuts against the fixing belt 51 is set to two, and the number of times the fixing belt 51 is heated in a state in which the pressure roller 52 is separated from the fixing belt 51 is set to two is described.

The control device 80 sets a heating time of the fixing belt 51 in a state in which the pressure roller 52 abuts against the fixing belt 51 and a heating time of the fixing belt 51 in a state in which the pressure roller 52 is separated from the fixing belt 51 (Act 52). The control device 80 sets the heating time of the fixing belt 51 in a state in which the pressure roller 52 abuts against the fixing belt 51 to a shorter time as the heat capacity of the pressure roller 52 decreases. The heating time in the contact state and the heating time in the separation state change depending on the heat capacities of the fixing belt 51 and the pressure roller 52, the environmental temperature and the temperature T0 of the fixing belt 51 before the warming-up processing. The heating time in the contact state and the heating time in the separation state are determined based on experiments using parameters such as the environmental temperature and the temperature T0 of the fixing belt 51 before the warming-up processing. A table showing the heating time in the contact state and the heating time in the separation state is stored in the ROM 100*a* in advance. The control device 80 sets the time with reference to the table. Here, a first contact time is t1, a first separation time is t2, a second contact time is t3, and a second separation time is t4. t1 and t3, and t2 and t4 may be the same or different. For example, t1 is 5 seconds, t2 is 3 seconds, t3 is 5 seconds, and t4 is 2 seconds.

Next, the control device 80 controls the pressure control device 300 to maintain the state in which the pressure roller 52 abuts against the fixing belt 51. As a result, the fixing belt 51 is heated while abutting against the pressure roller 52. The heat of the fixing belt 51 is accumulated in the pressure roller 52, and the temperature of the pressure roller 52 rises. The control device 80 continues heating the fixing belt 51 in a state in which the pressure roller 52 abuts against the fixing belt 51 for the time t1 (Act 53). The control device 80 controls the drive IC 88*b* to adjust the temperature of the fixing belt 51 to an appropriate temperature according to the detection results of the center thermistor 63*a* and the edge thermistor 63*b*.

The control device 80 controls the pressure control device 300 to separate the pressure roller 52 from the fixing belt 51. As a result, the fixing belt 51 is heated in a state of being separated from the pressure roller 52. Since the heat of the fixing belt 51 is not transmitted to the pressure roller 52, the surface temperature of the pressure roller 52 does not rise. The heat applied to the pressure roller 52 in Act 53 is transmitted to the inside of the pressure roller, and thus the surface temperature of the pressure roller 52 falls. The control device 80 continues heating the fixing belt 51 in a state in which the pressure roller 52 is separated from the fixing belt 51 for the time t2 (Act 54).

The control device 80 controls the pressure control device 300 to enable the pressure roller 52 to abut against the fixing belt 51. As a result, the fixing belt 51 is heated while abutting against the pressure roller 52. The heat of the fixing belt 51 is accumulated in the pressure roller 52, and the surface temperature of the pressure roller 52 rises. The control device 80 continues heating the fixing belt 51 in a state in which the pressure roller 52 abuts against the fixing belt 51 for the time t3 (Act 55).

The control device 80 controls the pressure control device 300 to separate the pressure roller 52 from the fixing belt 51. As a result, the fixing belt 51 is heated in a state of being separated from the pressure roller 52. Since the heat of the fixing belt 51 is not transmitted to the pressure roller 52, the surface temperature of the pressure roller 52 does not rise. The heat applied to the pressure roller 52 in Act 55 is transmitted to the inside of the pressure roller, and thus the surface temperature of the pressure roller 52 falls. The control device 80 continues heating the fixing belt 51 in a state in which the pressure roller 52 is separated from the fixing belt 51 for the time t4 (Act 56).

By repeating the heating in the contact state and the heating in the separation state, the temperature of the inside of the pressure roller 52 can be close to the surface temperature thereof while keeping the temperature of the pressure roller 52 within the range of the appropriate temperature. After finishing the processing in Act 56, the control device 80 terminates the warming-up processing.

When the warming-up process is completed, the MFP 10 shifts to the standby state. If the MFP 10 receives the print command after shifting to the standby state, the MFP 10 starts a printing operation. The MFP 10 forms the toner image on a paper P with the image forming section 17 and conveys the paper P to the direction of the fixing device 50.

As described above, the fixing device 50 according to the embodiment performs the second warming-up processing in which the heating of the fixing belt 51 in a state in which the pressure roller 52 abuts against the fixing belt 51 and the heating of the fixing belt 51 in a state in which the pressure roller 52 is separated from the fixing belt 51 are repeated alternately in the warming-up processing. If the temperature of the pressure roller 52 exceeds the appropriate temperature, the printing cannot be stopped because there is no temperature sensor for detecting the temperature of the pressure roller 52, and printing failure occurs. However, in the fixing device 50 according to the embodiment, by repeating the heating of the fixing belt 51 in a state in which the pressure roller 52 abuts against the fixing belt 51 and the heating of the fixing belt 51 in a state in which the pressure roller 52 is separated from the fixing belt 51, the temperature of the inside of the pressure roller 52 can be close to the surface temperature thereof while keeping the temperature of the pressure roller 52 within the range of the appropriate temperature. Since the fixing device 50 according to the embodiment keeps the temperature of the pressure roller 52 within the range of the appropriate temperature, it is possible to prevent the occurrence of printing failure at the start of printing.

The printing failure at the start of printing may also occur when the temperature of the pressure roller is not appropriate. Specifically, if the temperature of the pressure roller at the start of printing is lower than the appropriate temperature, since the heat of the fixing belt is taken away at the time the pressure roller abuts against the fixing belt, the temperature of the fixing belt is lower than the appropriate temperature, and thus the printing failure occurs. On the other hand, if the temperature of the pressure roller at the start of printing is higher than the appropriate temperature, the toner adheres to the fixing belt, and thus the printing failure occurs as well.

The appropriate temperature of the pressure roller is lower than that of the fixing belt. Therefore, if the warming-up processing is continued in a state in which the pressure roller abuts against the fixing belt, the temperature of the pressure roller becomes higher than the appropriate temperature of the pressure roller, and thus the printing failure occurs. Therefore, it is necessary to separate the pressure roller from the fixing belt during the warming-up processing.

The MFP generally has no temperature sensor for measuring the temperature of the pressure roller. In the conventional MFP, in the case in which the temperature T0 of the fixing belt 51 before the warming-up processing is low or in the case in which the environmental temperature is low, the inside of the pressure roller 52 may still not be heated even after the warming-up processing is finished. If the inside of the pressure roller 52 is still not heated, the pressure roller 52 abuts against the fixing belt 51 after receiving the print command, and in this way, the temperature of the fixing belt 51 is lowered and the printing failure occurs. Since the MFP waits for the printing until the temperature of the fixing belt 51 rises to the appropriate temperature, the waiting time from the reception of the print command to the start of printing becomes long. The user feels stressed if the waiting time from the reception of the print command to the start of printing becomes long.

The MFP 10 according to the present embodiment performs the second warming-up processing to heat even the inside of the pressure roller 52 to the appropriate temperature. In this way, it is possible to prevent the printing failure due to the low temperature of the fixing belt 51. Since an increase in the waiting time from the reception of the print command to execution of the printing can be prevented, the stress applied to the user can be reduced.

In the fixing device 50 according to the embodiment, the number of times the heating of the fixing belt 51 in a state in which the pressure roller 52 abuts against the fixing belt 51 and the heating of the fixing belt 51 in a state in which the pressure roller 52 is separated from the fixing belt 51 are repeated is set to a larger value as the temperature T0 of the fixing belt 51 before the warming-up processing becomes lower in the second warming-up processing. In this way, the temperature of the inside of the pressure roller 52 can be close to the surface temperature thereof while keeping the temperature of the pressure roller 52 within the range of the appropriate temperature. Since even the inside of the pressure roller 52 is heated, the waiting time from the reception of the print command to the execution of the printing is not long. Therefore, the stress applied to the user can be reduced.

In the fixing device 50 according to the embodiment, the number of times the heating of the fixing belt 51 in a state in which the pressure roller 52 abuts against the fixing belt 51 and the heating of the fixing belt 51 in a state in which the pressure roller 52 is separated from the fixing belt 51 are repeated is set to a larger value as the environmental temperature becomes lower in the second warming-up processing. In this way, in the fixing device 50, the temperature of the inside of the pressure roller 52 can be close to the surface temperature thereof while keeping the temperature of the pressure roller 52 within the range of the appropriate temperature. Since even the inside of the pressure roller 52 is heated, the waiting time from the reception of the print command to the execution of the printing is not long. Therefore, the stress applied to the user can be reduced.

In the fixing device 50 according to the embodiment, the heating time of the fixing belt 51 in a state in which the pressure roller 52 abuts against the fixing belt 51 is set according to the heat capacity of the pressure roller 52. In this way, the temperature of the pressure roller 52 can be prevented from exceeding the appropriate temperature. Therefore, the occurrence of the printing failure at the start of printing can be prevented.

In the fixing device 50 according to the embodiment, the number of times the heating of the fixing belt 51 in a state in which the pressure roller 52 abuts against the fixing belt 51 and the heating of the fixing belt 51 in a state in which the pressure roller 52 is separated from the fixing belt 51 are repeated is set according to the heat capacity of the image receiving medium. The heat quantity taken away by the image receiving medium becomes larger as the heat capacity of the image receiving medium increases. Therefore, the temperature of the fixing belt 51 largely falls at the start of printing as the heat capacity of the image receiving medium increases. However, in the fixing device 50 according to the embodiment, the number of times the heating of the fixing belt 51 in a state in which the pressure roller 52 abuts against the fixing belt 51 and the heating of the fixing belt 51 in a state in which the pressure roller 52 is separated from the fixing belt 51 are repeated is set to a larger value as the heat capacity of the image receiving medium increases in the second warming-up processing, and thus the heat quantity accumulated in the pressure roller 52 increases. In the fixing device 50 according to the embodiment, since the heat sufficiently accumulated in the pressure roller 52 through the second warming-up processing can be supplemented to the fixing belt 51, the decrease in the temperature of the fixing belt 51 can be prevented. Therefore, the occurrence of printing failure at the start of printing can be prevented. In addition, the waiting time for printing until the temperature of the fixing belt 51 rises to the appropriate temperature can be reduced.

Figure 8:
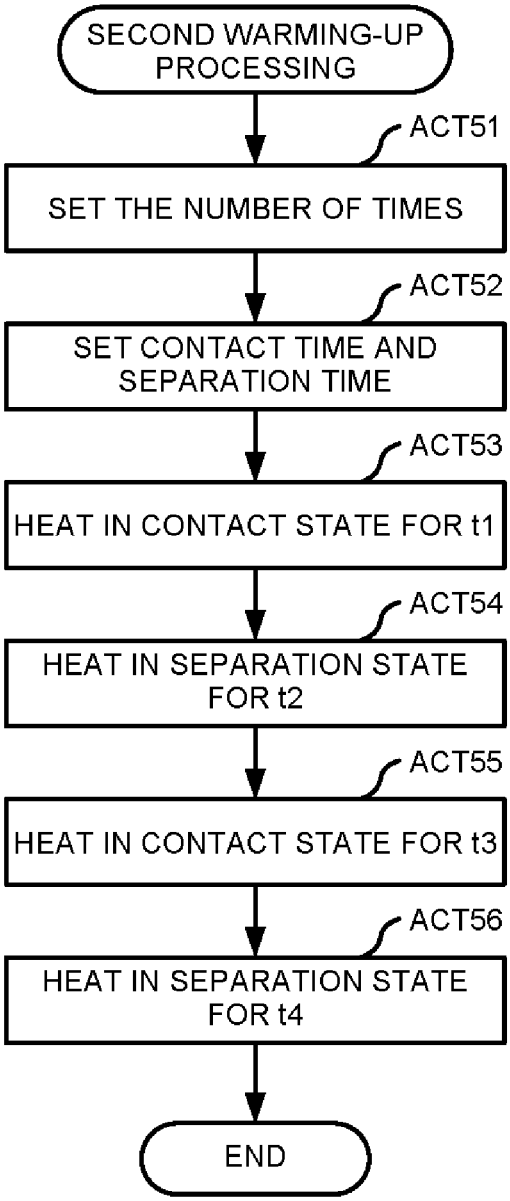
FIG. 8 is a flowchart depicting the warming-up processing performed by the image forming apparatus according to the first embodiment.

In the description of the second warming-up processing with reference to FIG. 8 described above, a case of starting from the processing of heating the fixing belt 51 in a state in which the pressure roller 52 abuts against the fixing belt 51 is described. However, the second warming-up processing may be started from the processing of heating the fixing belt 51 in a state in which the pressure roller 52 is separated from the fixing belt 51.

In the above description, the environmental temperature, the temperature of the fixing belt 51 before the warming-up processing, etc. are used as parameters for determining the number of times the heating in the contact state and the heating in the separation state are repeated, but a printing condition indicating whether the printing is a monochrome printing or a color printing may be added to the parameters for determining the number of times of repetition.

The standby temperature is, for example, 165° C. In the above description, the first warming-up processing is terminated if the temperature of the fixing belt 51 becomes equal to or higher than the temperature T2 (170° C.) in Act 36. In this case, the determination in Act 16 corresponds to the determination about whether to continue the warming-up processing after the temperature of the fixing belt 51 reaches the standby temperature.

In the above description, the temperature T2 is set to a temperature slightly higher than the standby temperature, but the temperature T2 may be set to a temperature lower than the standby temperature. The temperature T2 may be set to a temperature of the fixing belt 51 corresponding to the appropriate temperature of the pressure roller 52. In the case in which the temperature T2 is set to a temperature lower than the standby temperature, after the processing in Act 36 in FIG. 7, the fixing belt 51 in a state in which the pressure roller 52 is separated from the fixing belt 51 is heated until the temperature of the fixing belt 51 reaches the standby temperature of the fixing belt 51.

In the above description, the fixing belt 51 rotates as the pressure roller 52 rotates, but the fixing belt 51 may be rotationally driven. In this case, a ONE WAY clutch may be provided such that a speed difference between the fixing belt 51 and the pressure roller 52 does not occur. At the time of heating the fixing belt 51 in a state in which the pressure roller 52 is separated from the fixing belt 51, it is preferable that the fixing belt 51 is rotationally driven.

In the above description, the fixing belt 51 is heated through induction heating, but the heating element for heating the fixing belt 51 may be a ceramic heater, a halogen heater or a halogen lamp. The members forming the nip may be a combination of the pressure roller and the fixing belt, a heat roller and the fixing belt, the fixing belt and the pressure roller, or the heat roller and the pressure roller. These heating elements and nip forming parts may be combined in any manner.

In the above description, the layer structure of the fixing belt 51 is described in which the base material layer 51*a*, the heat generation layer 51*b*, the conductor layer 51*c*, the Ni layer 51*d*, the elastic layer 51*e* and the release layer 51*f* are laminated in this order from an inner circumferential side towards an outer circumferential side. However, the layer structure is not limited as long as the fixing belt 51 includes the heat generation layer 51*b*.

In the above embodiment, the image forming apparatus 10 is a multi-function peripheral. However, the image forming apparatus 10 is not limited thereto, and may be a laser printer or the like.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing device for fixing a toner image formed on an image receiving medium to the image receiving medium, comprising:

a heating rotation member that is rotatably supported;

a heating element configured to heat the heating rotation member;

a pressure rotation member configured to be pressed against the heating rotation member to form a nip therebetween, through which the image receiving medium passes;

a pressure control device configured to control a pressure at which the pressure rotation member abuts against the heating rotation member; and a control device configured to perform a warming-up process for raising a temperature of the heating rotation member and the pressure rotation member to a standby temperature before fixing the toner image on the image receiving medium, wherein, during the warming-up process, the control device is configured to control the heating element and the pressure control device to alternately perform:

a first process that heats the heating rotation member while the pressure rotation member abuts against the heating rotation member; and a second process that heats the heating rotation member while the pressure rotation member is separated from the heating rotation member; and wherein the control device is configured to alternately repeat the first process and the second process based on at least one of (i) a temperature of the heating rotation member before the warming-up process or (ii) an environmental temperature.

2. The fixing device of claim 1, wherein the control device is configured to continue to perform the warming-up process after the temperature of the heating rotation member reaches the standby temperature.

3. The fixing device of claim 1, wherein the control device is configured to alternately repeat the first process and the second process based on a temperature of the heating rotation member before the warming-up process.

4. The fixing device of claim 1, wherein the control device is configured to alternately repeat the first process and the second process based on an environmental temperature.

5. The fixing device of claim 1, wherein the control device is configured to set a time required for heating the heating rotation member while the pressure rotation member abuts against the heating rotation member based on a heat capacity of the pressure rotation member.

6. The fixing device of claim 1, wherein the control device is configured to not perform control to alternately repeat the first process and the second process in response to a determination that the temperature of the heating rotation member is equal to or higher than a preset temperature before the warming-up process.

7. The fixing device of claim 1, wherein the control device is configured to not perform control to alternately repeat the first process and the second process in response to a determination that an environmental temperature is equal to or higher than a preset temperature.

8. The fixing device of claim 1, wherein the pressure control device comprises:

a cam;

an elastic body coupled to the pressure rotation member and abutting the cam; and a driver configured to rotate the cam to control the pressure at which the pressure rotation member abuts against the heating rotation member.

9. The fixing device of claim 1, wherein the heating rotation member includes an induction heating coil configured to generate a magnetic flux, and wherein the heating rotation member includes a fixing belt having a heat generation layer configured to generate an induced current in response to experiencing the magnetic flux.

10. The fixing device of claim 9, further comprising a temperature sensor positioned inside of the fixing belt and configured to sense heat generation within the heating rotation member, wherein the control device is configured to control the heating element based on the heat generation sensed by the temperature sensor.

11. A fixing device for fixing a toner image formed on an image receiving medium to the image receiving medium, comprising:

a heating rotation member that is rotatably supported;

a heating element configured to heat the heating rotation member;

a pressure rotation member configured to be pressed against the heating rotation member to form a nip therebetween, through which the image receiving medium passes;

a pressure control device configured to control a pressure at which the pressure rotation member abuts against the heating rotation member; and a control device configured to perform a warming-up process for raising a temperature of the heating rotation member and the pressure rotation member to a standby temperature before fixing the toner image on the image receiving medium, wherein, during the warming-up process, the control device is configured to control the heating element and the pressure control device to alternately perform:

a first process that heats the heating rotation member while the pressure rotation member abuts against the heating rotation member; and a second process that heats the heating rotation member while the pressure rotation member is separated from the heating rotation member; and wherein the control device is configured to set a number of times that the first process and the second process are alternately repeated based on a heat capacity of the image receiving medium.

12. The fixing device of claim 11, wherein the control device is configured to alternately repeat the first process and the second process based on a temperature of the heating rotation member before the warming-up process.

13. A fixing device for fixing a toner image formed on an image receiving medium to the image receiving medium, comprising:

a heating rotation member that is rotatably supported;

a heating element configured to heat the heating rotation member;

a pressure rotation member configured to be pressed against the heating rotation member to form a nip therebetween, through which the image receiving medium passes;

a pressure control device configured to control a pressure at which the pressure rotation member abuts against the heating rotation member; and a control device configured to perform a warming-up process for raising a temperature of the heating rotation member and the pressure rotation member to a standby temperature before fixing the toner image on the image receiving medium, wherein, during the warming-up process, the control device is configured to control the heating element and the pressure control device to alternately perform:

a first process that heats the heating rotation member while the pressure rotation member abuts against the heating rotation member; and a second process that heats the heating rotation member while the pressure rotation member is separated from the heating rotation member; and wherein the control device is configured to alternately repeat the first process and the second process more times when color printing than when monochrome printing.

14. A method of warming-up a fixing device configured to fix a toner image onto an image receiving medium, wherein the fixing device includes a heating rotation member and a pressure rotation member configured to receive the image receiving medium therebetween, the method comprising:

with the pressure rotation member separated from the heating rotation member, heating the heating rotation member until the heating rotation member is at least a first threshold temperature and until at least a threshold time has elapsed since beginning to heat the heating rotation member, wherein the threshold time is based on an environmental temperature;

with the pressure rotation member abutting the heating rotation member, heating the heating rotation member until the heating rotation member is at least a second threshold temperature, wherein the second threshold temperature is greater than the first threshold temperature.

15. A method of warming-up a fixing device configured to fix a toner image onto an image receiving medium, wherein the fixing device includes a heating rotation member and a pressure rotation member configured to receive the image receiving medium therebetween, the method comprising:

with the pressure rotation member separated from the heating rotation member, heating the heating rotation member until the heating rotation member is at least a first threshold temperature;

with the pressure rotation member abutting the heating rotation member, heating the heating rotation member until the heating rotation member is at least a second threshold temperature, wherein the second threshold temperature is greater than the first threshold temperature;

determining if an initial temperature of the heating rotation member is greater than a third threshold temperature; and in response to a determination that the initial temperature is greater than the third threshold temperature, alternately (a) heating the heating rotation member with the pressure rotation member separated from the heating rotation member and (b) heating the heating rotation member with the pressure rotation member abutting the heating rotation member a number of times, wherein the number of times is at least one.

16. The method of claim 15, wherein the third threshold temperature is based on at least one of (a) an environmental temperature, (b) a heat capacity of the image receiving medium, (c) a heat capacity of the heating rotation member, or (d) a heat capacity of the pressure rotation member.

17. The method of claim 15, further comprising determining the number of times based on at least one of (a) the initial temperature of the heating rotation member, (b) an environmental temperature, or (c) a heat capacity of the pressure rotation member.

18. The method of claim 15, wherein alternately (a) heating the heating rotation member with the pressure rotation member separated from the heating rotation member and (b) heating the heating rotation member with the pressure rotation member abutting the heating rotation member the number of times comprises:

heating the heating rotation member for a first contact time with the pressure rotation member abutting the heating rotation member;

heating the heating rotation member for a first separation time with the pressure rotation member separated from the heating rotation member;

heating the heating rotation member for a second contact time with the pressure rotation member abutting the heating rotation member; and heating the heating rotation member for a second separation time with the pressure rotation member separated from the heating rotation member, wherein the method further comprises determining at least one of the first contact time, the first separation time, the second contact time, or the second separation time based on at least one of (a) an environmental temperature or (b) the initial temperature of the heating rotation member.

19. The method of claim 18, wherein the first contact time is different than the second contact time, and wherein the first contact time is different than the first separation time.

20. The method of claim 15, wherein, with the pressure rotation member separated from the heating rotation member, heating the heating rotation member until the heating rotation member is at least the first threshold temperature includes heating the heating rotation member until the heating rotation member is at least the first threshold temperature and until at least a threshold time has elapsed since beginning to heat the heating rotation member, wherein the threshold time is based on an environmental temperature.

* * * * *